US007342541B2

(12) United States Patent
Harano

(10) Patent No.: US 7,342,541 B2
(45) Date of Patent: Mar. 11, 2008

(54) MOBILE TELEPHONE

(75) Inventor: Nobuya Harano, Shizuoka (JP)

(73) Assignee: NEC Corporation, Tokyo (JP)

( * ) Notice: Subject to any disclaimer, the term of this patent is extended or adjusted under 35 U.S.C. 154(b) by 109 days.

(21) Appl. No.: 11/225,056

(22) Filed: Sep. 14, 2005

(65) Prior Publication Data

US 2006/0055609 A1 Mar. 16, 2006

(30) Foreign Application Priority Data

Sep. 15, 2004 (JP) ..... 2004-268371

(51) Int. Cl.
*H01Q 1/24* (2006.01)

(52) U.S. Cl. ..... 343/702

(58) Field of Classification Search ..... 343/702, 343/700 MS, 829, 846
See application file for complete search history.

(56) References Cited

U.S. PATENT DOCUMENTS

| | | | | |
|---|---|---|---|---|
| 6,229,485 | B1 * | 5/2001 | Ito et al. | 343/700 MS |
| 6,246,374 | B1 * | 6/2001 | Perrotta et al. | 343/702 |
| 6,285,327 | B1 * | 9/2001 | See | 343/702 |
| 6,459,412 | B1 | 10/2002 | Koyanagi et al. | |
| 6,507,318 | B2 | 1/2003 | Ito et al. | |
| 6,563,467 | B1 | 5/2003 | Buris et al. | |
| 6,667,717 | B2 | 12/2003 | Mitsui | |
| 6,697,025 | B2 | 2/2004 | Koyanagi et al. | |
| 7,002,521 | B2 * | 2/2006 | Egawa et al. | 343/702 |
| 7,038,626 | B2 * | 5/2006 | Gothard et al. | 343/702 |
| 7,162,264 | B2 * | 1/2007 | Vance | 455/550.1 |

FOREIGN PATENT DOCUMENTS

| | | | |
|---|---|---|---|
| EP | 1 199 769 | A1 | 4/2002 |
| JP | 2000-315909 | A | 11/2000 |
| JP | 2001-503586 | A | 3/2001 |
| JP | 2001-156517 | A | 6/2001 |
| JP | 2001-257522 | A | 9/2001 |
| JP | 2001-326524 | A | 11/2001 |
| JP | 2002-043826 | A | 2/2002 |
| JP | 2002-344231 | A | 11/2002 |
| JP | 2003-179421 | A | 6/2003 |
| JP | 2004-112039 | A | 4/2004 |
| JP | 2004-134975 | A | 4/2004 |
| JP | 2005-150998 | A | 6/2005 |
| JP | 2006-25015 | A | 1/2006 |
| WO | 03/067702 | A2 | 8/2003 |

* cited by examiner

*Primary Examiner*—Tho Phan
(74) *Attorney, Agent, or Firm*—Sughrue Mion, PLLC

(57) ABSTRACT

A mobile telephone that can suppress the deterioration of antenna characteristics caused by a conduction current. It comprises an inverse element 60 provided in a region where, looking from the side of an antenna 50, at least the antenna 50 and a conductive part 21 overlap, disposed between the antenna 50 and the conductive part 21 at prescribed, respective distances from the both, so as to guide a current flowing from the conductive part 21 to flow in the inverse direction to that in which the current flows in the conductive part 21.

20 Claims, 13 Drawing Sheets

MOBILE TELEPHONE

FIELD OF THE INVENTION

The present invention relates to a mobile telephone and particularly a mobile telephone that can suppress the deterioration of antenna characteristics caused by a conduction current flowing through a conductive part.

BACKGROUND OF THE INVENTION

In recent years, the mainstream of mobile telephones has been the type in which two casings are foldably jointed by a joint part (mechanical joint parts such as hinge part, rotating part, and revolving part) since this type can be small in size, and protect its display screen and operation surface. Also, the type in which an external antenna and internal antenna are provided near the joint part of each casing has increased because this type allows foldable mobile telephones to be thinner and offers better usability.

A structural example of a conventional foldable mobile telephone will be described using drawings. Referring to FIG. 11, a mobile telephone 101 is made up by foldably jointing a first casing (refer to a first casing external surface 110) and a second casing (refer to a second casing external surface 120), and it comprises a first conductive part 111, a second conductive part 121, a joint part 130, a power supply (feeder) part 140 and an antenna 150.

The first conductive part 111 includes a conductive part (member) of components (circuit substrates, electronic parts, frames, etc.) housed in the first casing and a conductive part of the first casing in some cases, and as a whole, it can be considered to be a plate-shaped part disposed inside the first casing in terms of antenna characteristics. Likewise, the second conductive part 121 includes the conductive part of components (circuit substrates, electronic parts, frames, etc.) housed in the second casing and a conductive part of the second casing in some cases, and as a whole, it can be considered to be a plate-shaped part disposed inside the second casing in terms of antenna characteristics. The joint part 130 mechanically joints the first conductive part 111 and the second conductive part 121, and it becomes a pivotable part when the mobile telephone is folded. The power supply part 140 feeds power to the antenna 150, and is provided near the joint part 130 of the first conductive part 111 inside the first casing. The antenna 150 is led out from the area near the joint part 130 of the first conductive part 111 to the outside of the first casing (refer to the first casing external surface 110), and becomes an external antenna extended towards the second casing (refer to the second casing external surface 120) when the mobile telephone is opened. The antenna 150 is electrically connected to the power supply part 140, and operates as an antenna by being excited for oscillation between itself and the first conductive part 111. The tip of the antenna 150 is spiral shaped. When the mobile telephone 101 is opened, the extended part near the tip of the antenna 150 is at a position close to the second conductive part 121 and at a prescribed distance from the second casing external surface 120.

[Patent-Document 1]
Japanese Patent Kokai Publication No. P2001-257522A
[Patent-Document 2]
Japanese Patent Kokai Publication No. P2001-156517A
[Patent-Document 3]

-continued

Japanese Patent Kokai Publication No. P2001-326524A
[Patent-Document 4]
Japanese Patent Kokai Publication No. P2003-179421A
[Patent-Document 5]
Japanese Patent Kokai Publication No. P2002-043826A
[Patent-Document 6]
Japanese Patent Kokai Publication No. P2002-344231A

SUMMARY OF THE DISCLOSURE

The antenna characteristics of the type of antenna shown in FIG. 11 vary greatly depending on whether or not the mobile telephone is folded, and it is difficult to maintain good antenna characteristics especially when the mobile telephone is opened. Hereinafter, detailed explanations will be made with references to the drawings.

FIG. 12 is a schematic diagram for explaining how a current flows when the casings are opened and the joint part (130 in FIG. 11) of a foldable mobile telephone relating to the conventional example is not conductive. In such a structure, a current $I_a$ of the antenna 150, which is excited by the power supply part 140, flows in the first conductive part 111 as well. Since the first conductive part 111 and the second conductive part 121 are not electrically connected by the joint part 130, the current does not flow from the first conductive part 111 to the second conductive part 121. However, because the extending direction of the second conductive part 121 is essentially the same as that of the antenna 150 (when two directions form an acute angle, they have vector components in the same direction), an induced current $I_b$, by the current $I_a$ flowing in the antenna 150, flows in the second conductive part 121. The direction of the induced current $I_b$ flowing in the second conductive part 121 is essentially the same as that of the current $I_a$ flowing in the antenna 150 (towards the connector 130). In such a state, the power from the antenna 150 induces a current to flow in the second conductive part 121, and the antenna characteristics of the whole apparatus deteriorate due to the conduction loss in the second conductive part 121.

FIG. 13 is a schematic diagram for explaining how a current flows when the casings are opened and the joint part (130 in FIG. 11) of a foldable mobile telephone relating to the conventional example is conductive. In such a structure, a current $I_a$ flowing in the antenna 150, which is excited by the power supply part 140, flows in the first conductive part 111 as well, and since the first conductive part 111 and the second conductive part 121 are electrically connected by the conductive joint part 130, the current also flows from the first conductive part 111 to the second conductive part 121. Further, because the direction of the current that flows in the second conductive part 121 goes away from the joint part 130, it essentially flows in the opposite direction to the current $I_a$ that flows in the antenna 150 (when the directions of two currents form an acute angle, they have vector components in the opposite direction). Therefore, the current $I_a$ that flows in the antenna 150 decreases due to the dielectric action of the conduction current flowing in the second conductive part 121. In other words, an induced current caused by the dielectric action of the antenna 150 also flows in the second conductive part 121, however, since the induced current flowing in the second conductive part 121 is small compared to the conduction current flowing in the second conductive part 121, the current $I_a$ that flows in the antenna 150 decreases greatly due to the dielectric action of the conduction current flowing in the second conductive part 121. As described above, in case where the first conductive part 111 and the second conductive part 121 are electrically connected, antenna characteristics deteriorate due to the conduction current flowing in the second conductive part 121.

In the prior art, a technology wherein a radiation element is formed on one surface of the insulator, a grounding plate is formed on the other surface, a central conductor of a coaxial cable for supplying power to the radiation element is electrically connected to the radiation element, and an outer conductor of the coaxial cable is electrically connected to the grounding plate at two points spaced from each other by approximately a quarter of the wavelength of current flowing through the outer conductor (refer to Patent-Document 6). If leakage current flows along the outer conductor, the leakage current will be negated by an inverse-phase current flowing through the grounding plate, however, the power from the radiation element will flow in the grounding plate, and the radiation characteristics (the antenna characteristics) of the whole apparatus will deteriorate due to the conduction loss of the grounding plate. Thus there is much desired in the art.

It is an object of the present invention to provide a mobile telephone that can suppress the deterioration of antenna characteristics caused by a conduction current.

According to a first aspect of the present invention, a mobile telephone comprises an inverse element provided in a whole or part of a region where, looking from the side of an antenna, at least the antenna and a conductive part overlap, disposed between the antenna and the conductive part at prescribed, respective distances from the both, in a fashion to guide a current flowing from the conductive part to flow in an inverse direction to that in which the current flows in the conductive part.

According to a second aspect of the present invention, a mobile telephone comprises an inverse element disposed in a whole or part of a region where, looking from the side of an antenna, at least the antenna and a conductive part overlap, provided between the antenna and the conductive part at prescribed, respective distances from the both, and electrically connected to the conductive part via at least one (or two or more) connecting part at a position away from a part of the conductive part that supplies power to the antenna, looking from the side of the antenna, and further away from a tip of the antenna.

According to a third aspect of the present invention, a mobile telephone comprises a conductive part disposed at a prescribed position or positions of one or both of a casing and a member mounted inside the casing, an antenna led (taken) out outside the casing and extended towards a prescribed direction near the conductive part, a power supply (feeder) part provided at a prescribed position of the conductive part and supplying power to the antenna, and an inverse element disposed in a whole or part of a region where, looking from the side of the antenna, at least the antenna and the conductive part overlap, provided between the antenna and the conductive part at prescribed, respective distances from the both, in a fashion to guide a current flowing from the conductive part to flow in the inverse direction to that in which the current flows in the conductive part.

According to a fourth aspect of the present invention, a mobile telephone comprises a conductive part disposed at a prescribed position or positions of one or both of a casing and a member mounted inside the casing, an antenna led out outside the casing and extended towards a prescribed direction near the conductive part, a power supply part provided at a prescribed position of the conductive part and supplying power to the antenna, and an inverse element disposed in a whole or part of a region where, looking from the side of the antenna, at least the antenna and the conductive part overlap, provided between the antenna and the conductive part at prescribed, respective distances from the both, and electrically connected to the conductive part via at least one (or two or more) connecting part at a position away from the power supply part, looking from the side of the antenna, and further away from a tip of the antenna.

According to a fifth aspect of the present invention, a mobile telephone comprises a first conductive part disposed at a prescribed position of one or both of a first casing and a member mounted inside the first casing, a second conductive part disposed at a prescribed position of one or both of a second casing and a member mounted inside the second casing, foldably jointed to the first conductive part by a joint part, and electrically connected to the first conductive part, an antenna led out outside the first casing from an area near the joint part of the first casing and extended towards a prescribed direction near the second conductive part when the first and second casings are opened, a power supply part provided near the joint part of the first conductive part and supplying power to the antenna, and an inverse element disposed in a whole or part of a region where, looking from the side of the antenna, at least the antenna and the second conductive part overlap when the first and second casings are opened, provided between the antenna and the second conductive part at prescribed, respective distances from the both, in a fashion to guide a current flowing from the second conductive part to flow in the inverse direction to that in which the current flows in the second conductive part.

According to a sixth aspect of the present invention, a mobile telephone comprises a first conductive part disposed at a prescribed position of one or both of a first casing and a member mounted inside the casing, a second conductive part disposed at a prescribed position of one or both of a second casing and a member mounted inside the casing, foldably jointed to the first conductive part by a joint part, and electrically connected to the first conductive part, an antenna led out outside the first casing from an area near the joint part of the first casing and extended towards a prescribed direction near the second conductive part when the first and second casings are opened, a power supply part provided near the joint part of the first conductive part and supplying power to the antenna, and an inverse element disposed in a whole or part of a region where, looking from the side of the antenna, at least the antenna and the second conductive part overlap when the first and second casings are opened, provided between the antenna and the second conductive part at prescribed, respective distances from the both, and electrically connected to the second conductive part via at least one (or two or more) connecting part at a position away from the joint part, looking from the side of the antenna, and further away from a tip of the antenna.

In the mobile telephone according to the present invention, it is preferable that the inverse element be a plate-shaped conductor and disposed approximately parallel to one or both of the second conductive part and the antenna.

In the mobile telephone according to the present invention, the inverse element may have either a hole or notch or both at a prescribed position.

In the mobile telephone according to the present invention, the inverse element may be small in the long direction when the communication wavelength is short for (relative to) the length of the casing, and big in the long direction when the communication wavelength is long for (relative to) the length of the casing.

In the mobile telephone according to the present invention, the inverse element may be small in the short direction when the communication wavelength is long for the length of the casing, and big in the short direction when the communication wavelength is short for the length of the casing.

In the mobile telephone according to the present invention, the width of the inverse element in the short direction at a position of the joint part may be narrower than the width in the short direction at a position of the connecting part.

In the mobile telephone according to the present invention, the tip of the antenna may be coil-shaped.

In the mobile telephone according to the present invention, the connecting part may be disposed near the joint part when the communication wavelength is short for the length of the casing, and away from the joint part when the communication wavelength is long for the length of the casing.

In the mobile telephone according to the present invention, the connecting part may comprise a connector.

In the mobile telephone according to the present invention, the connecting part may be made up of a cushioning conductive material and interposed between the inverse element and the second conductive part.

In the mobile telephone according to the present invention, the connecting part may have a capacitive coupling portion for a high-frequency current.

The mobile telephone according to the present invention may comprise a spacer made up of an insulating material and interposed between the inverse element and the second conductive part.

In the mobile telephone according to the present invention, the spacer may be made up of an insulating cushioning material.

The meritorious effects of the present invention are summarized as follows.

According to the present invention (claims 1 to 18), the phase of a conduction current flowing in a conductive part is controlled by the inverse element, improving antenna characteristics.

According to the present invention (claims 9 to 11, and 13), the deterioration of antenna characteristics caused by a conduction current flowing in the second conductive part can be suppressed while matching impedances.

BRIEF DESCRIPTIONS OF THE DRAWINGS

Figure 3A:
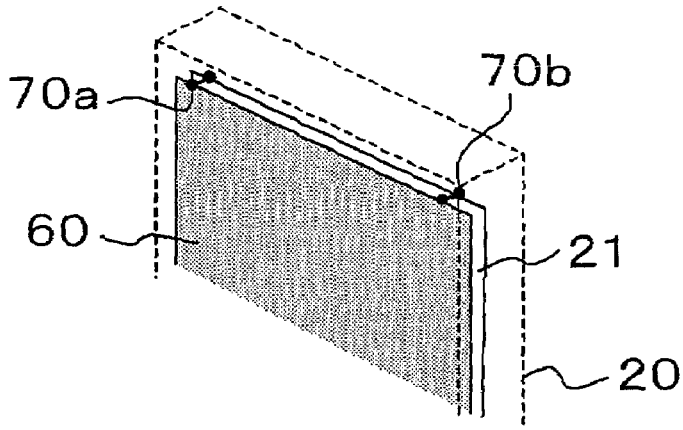
Figure 3B:
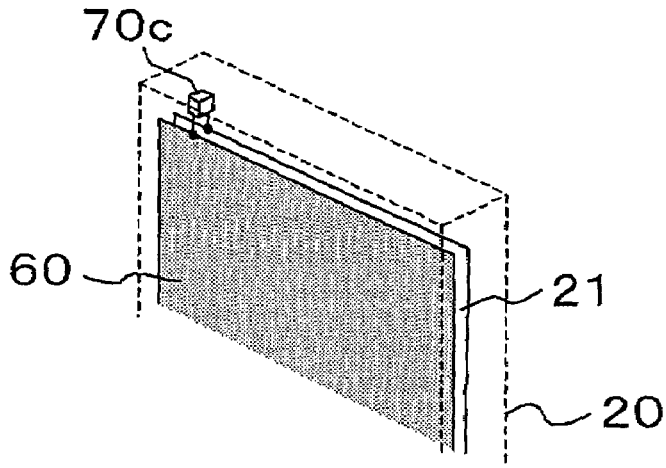
Figure 3C:
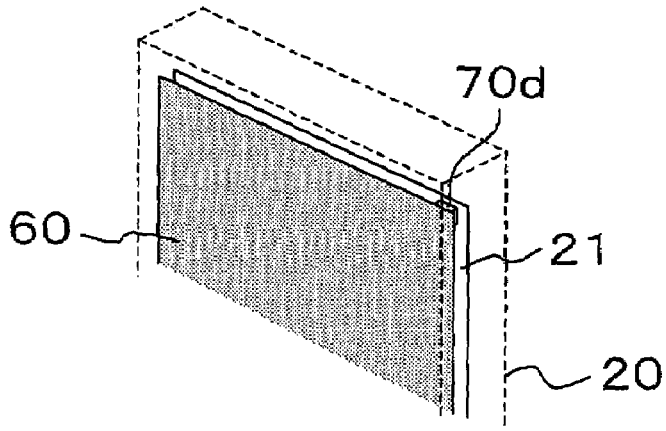

FIGS. 3A, 3B, and 3C are partial perspective views schematically showing variations of the connecting part in the structure of the mobile telephone relating to Embodiment 1 of the present invention.

Figure 4:
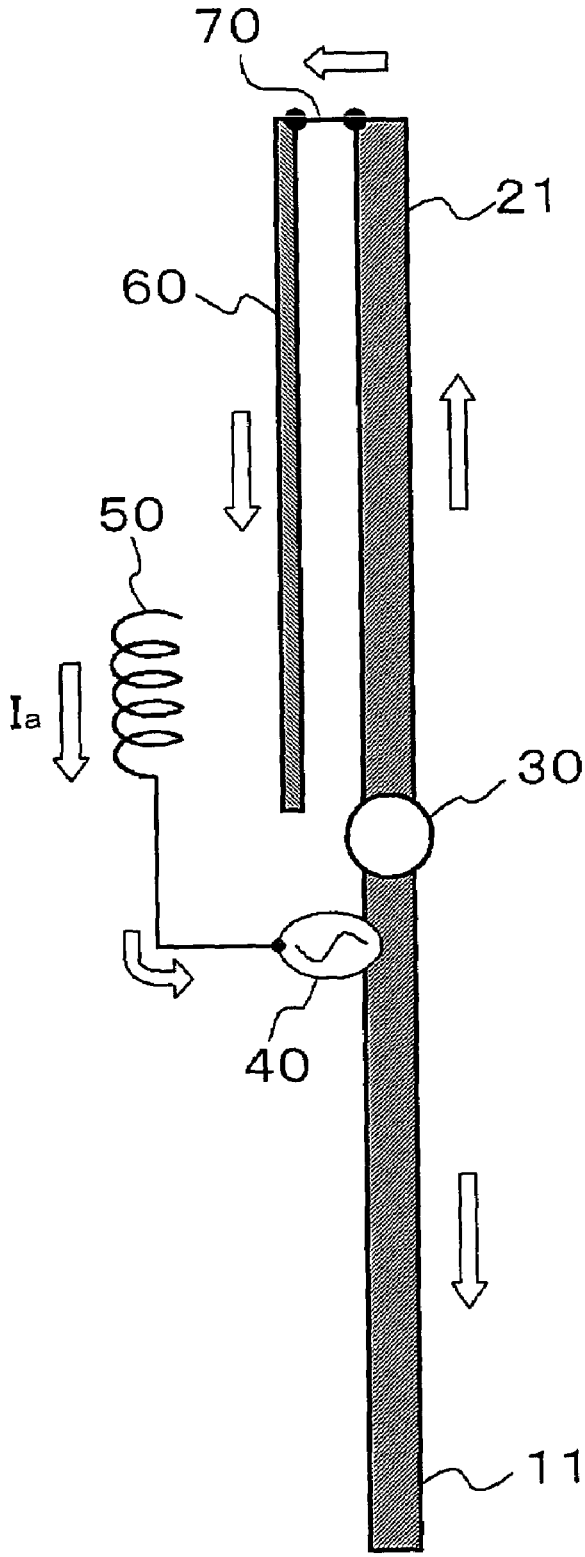

FIG. 4 is a schematic cross-section for explaining the current flow in the mobile telephone relating to Embodiment 1 of the present invention.

Figure 5:
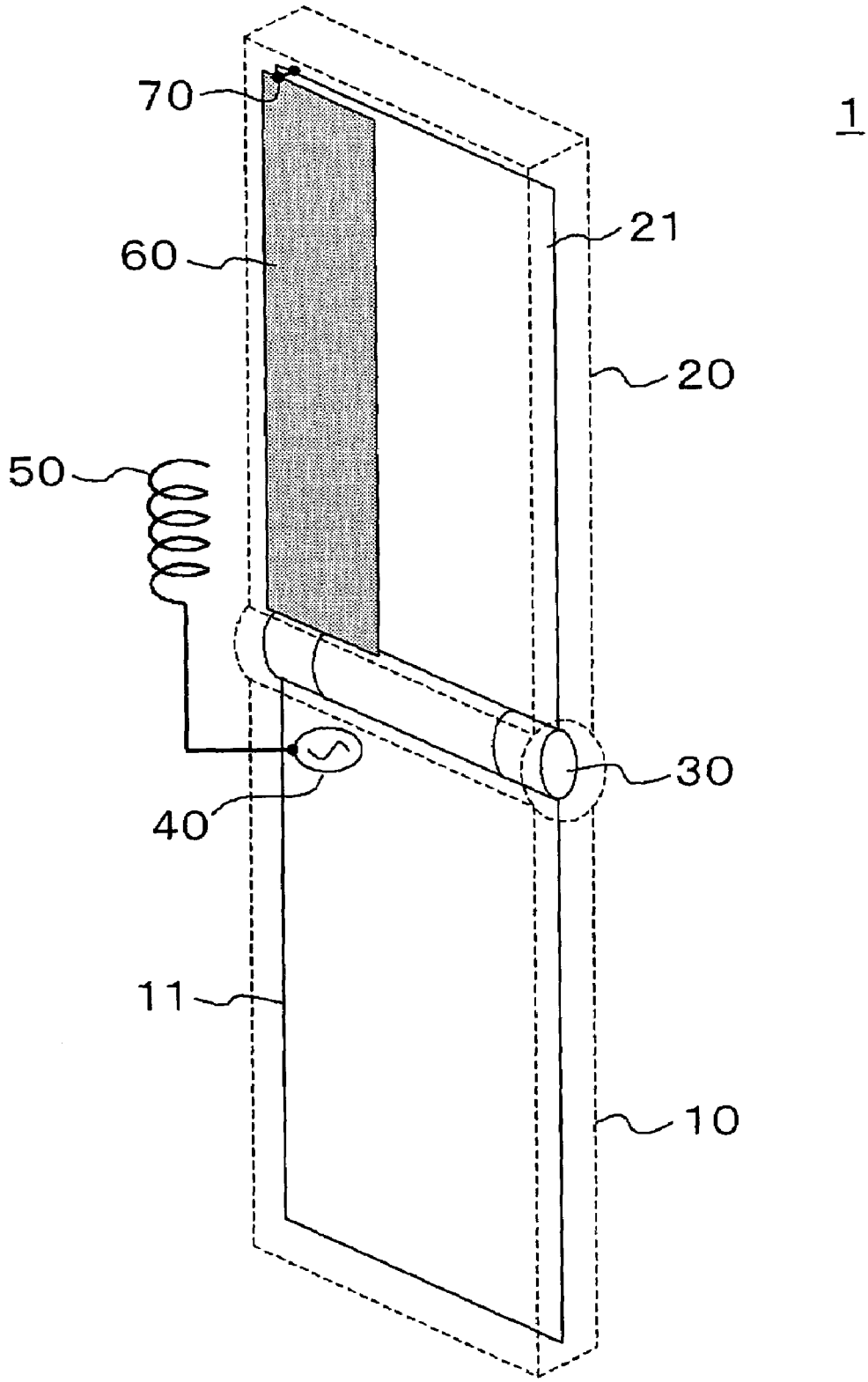

FIG. 5 is a perspective view schematically showing the structure of a mobile telephone relating to Embodiment 2 of the present invention.

Figure 6A:
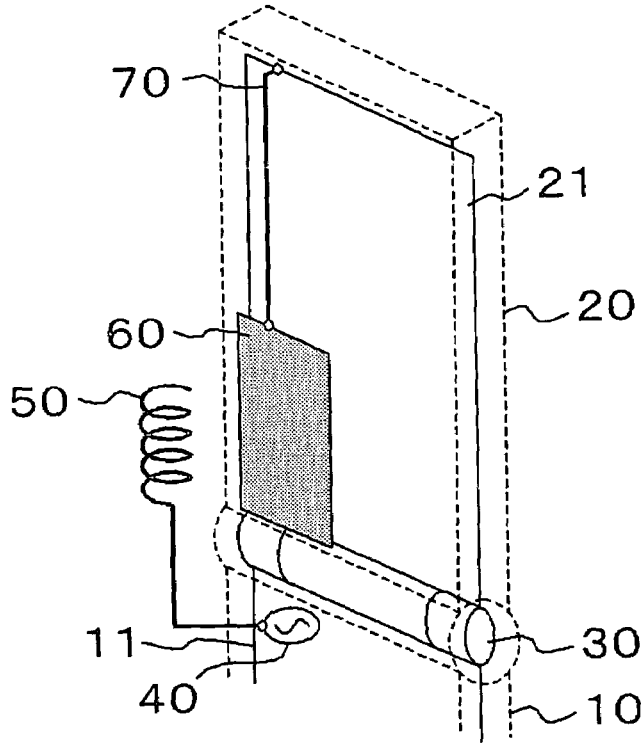

FIGS. 6A and B are perspective views schematically showing variations of the structure of the mobile telephone relating to Embodiment 2 of the present invention.

Figure 7A:
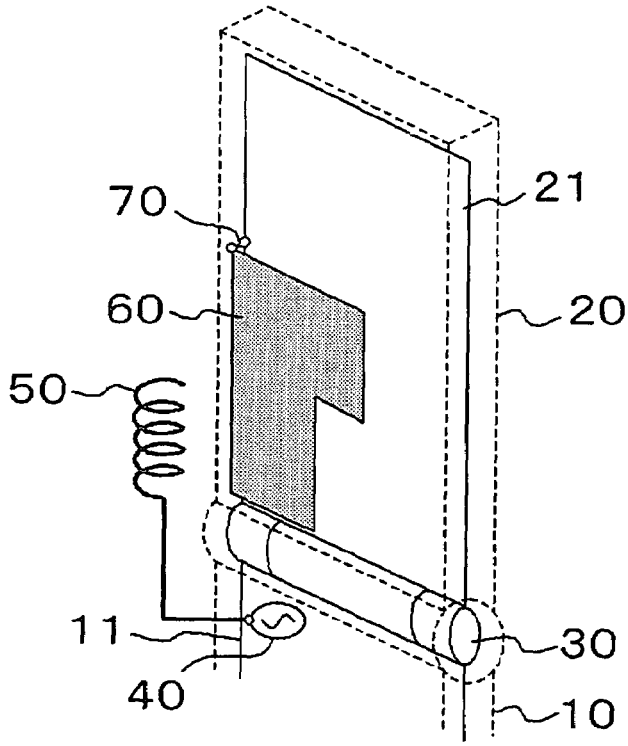
Figure 7B:
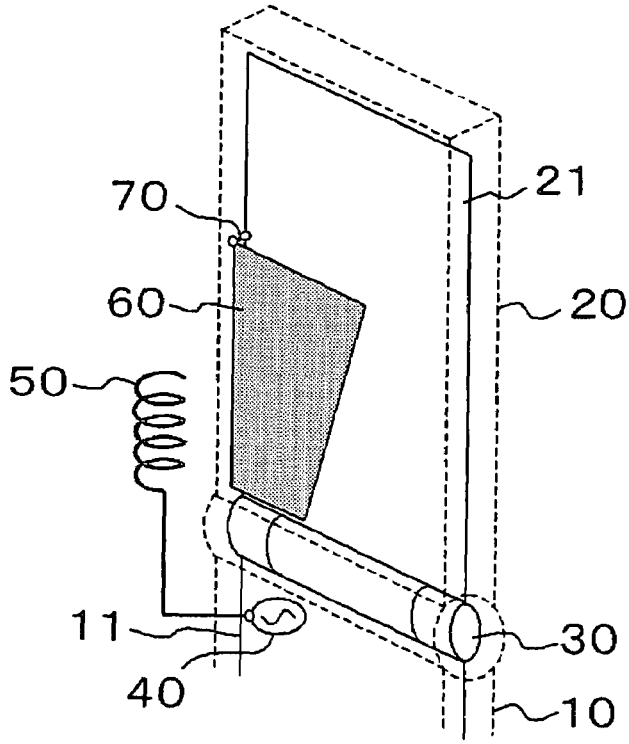

FIGS. 7A and 7B are perspective views schematically showing variations of the structure of the mobile telephone relating to Embodiment 2 of the present invention.

Figure 8:
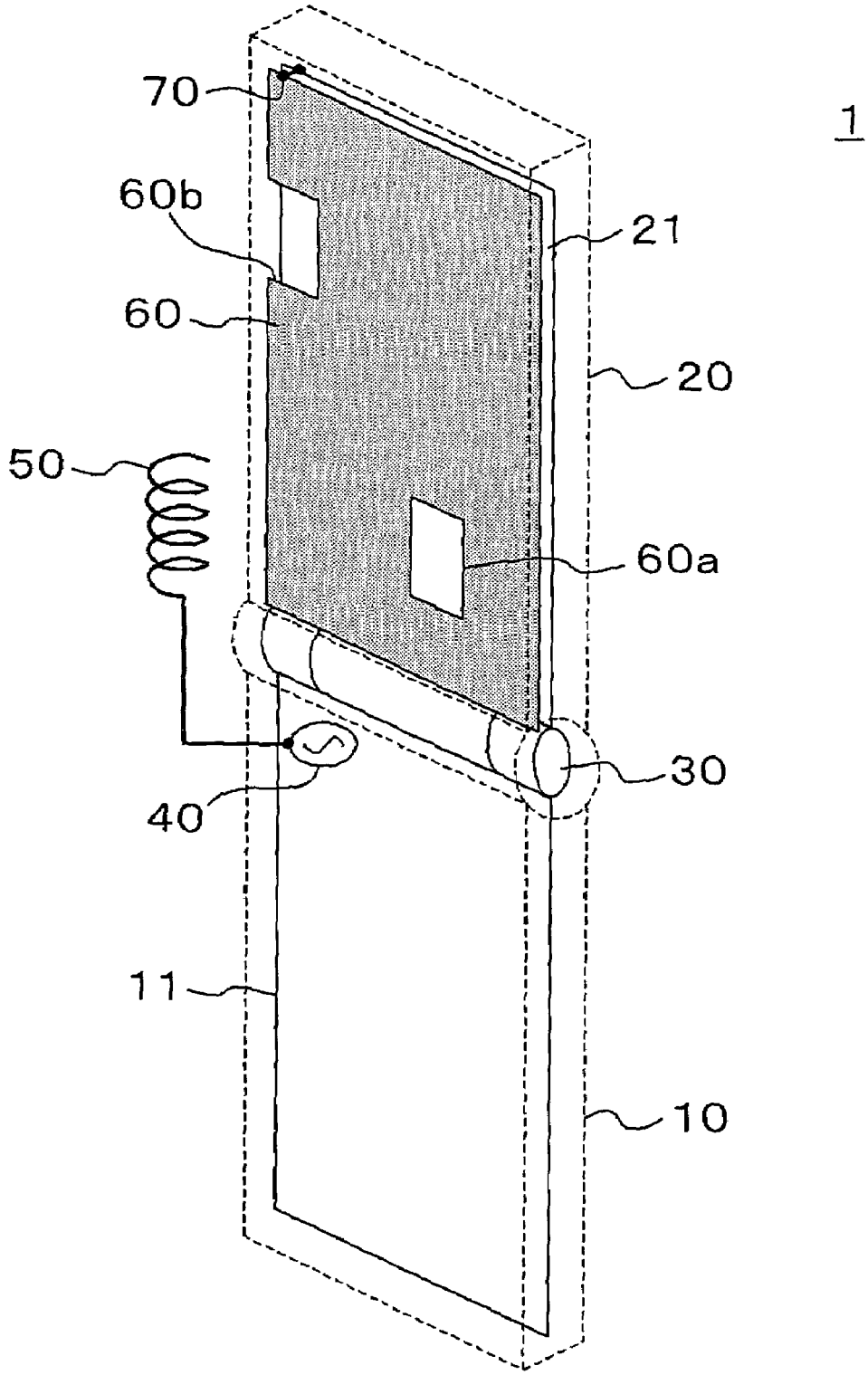

FIG. 8 is a perspective view schematically showing the structure of a mobile telephone relating to Embodiment 3 of the present invention.

Figure 9:
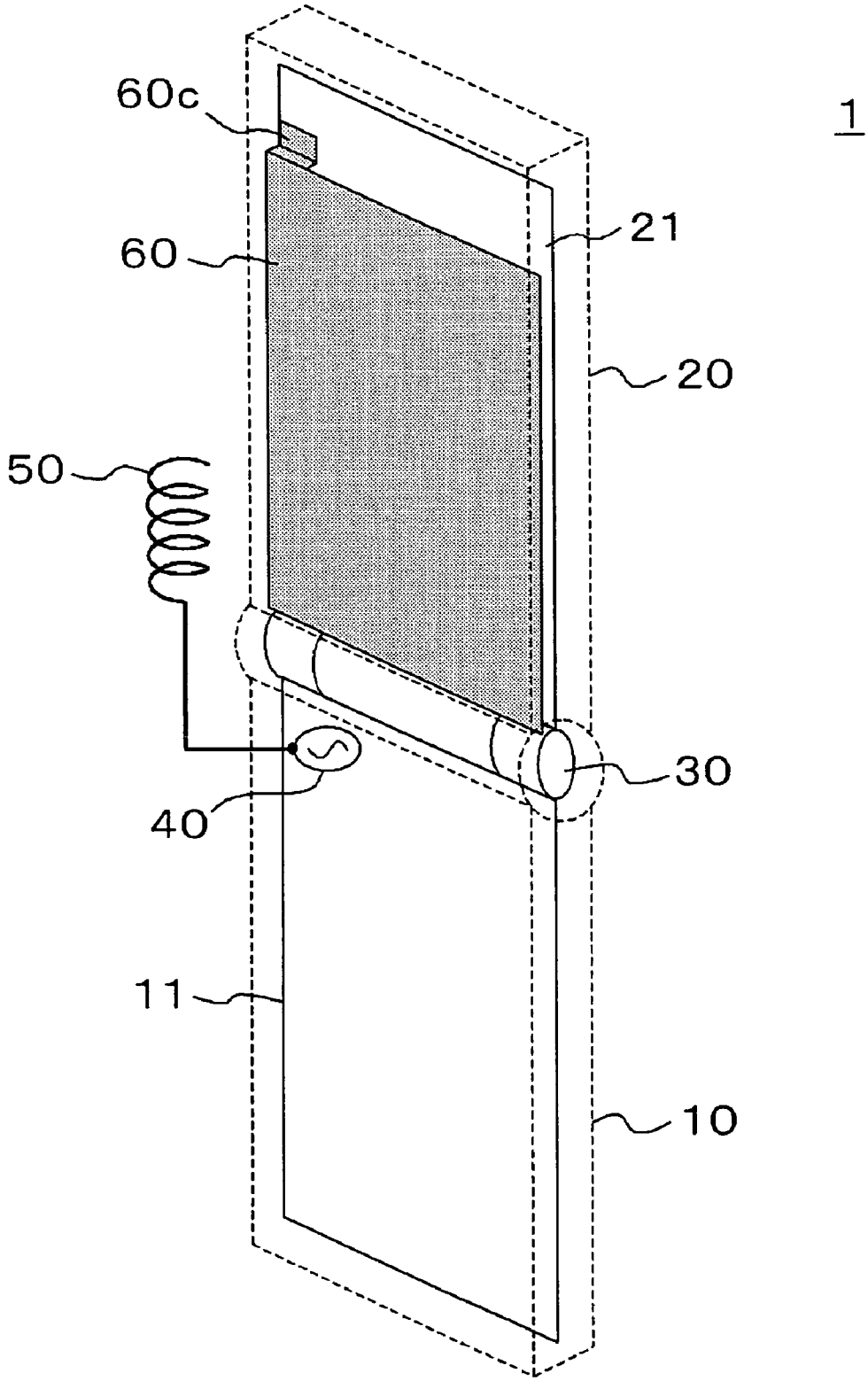

FIG. 9 is a perspective view schematically showing the structure of a mobile telephone relating to Embodiment 4 of the present invention.

Figure 10:
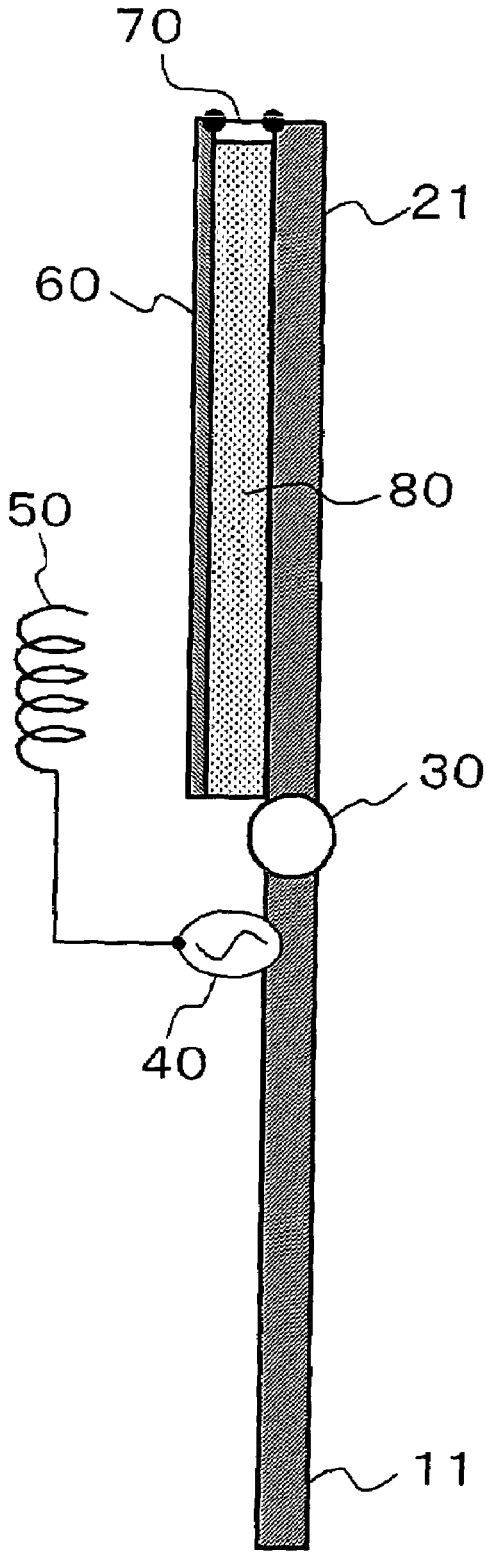

FIG. 10 is a cross-section schematically showing the structure of a mobile telephone relating to Embodiment 5 of the present invention.

Figure 11:
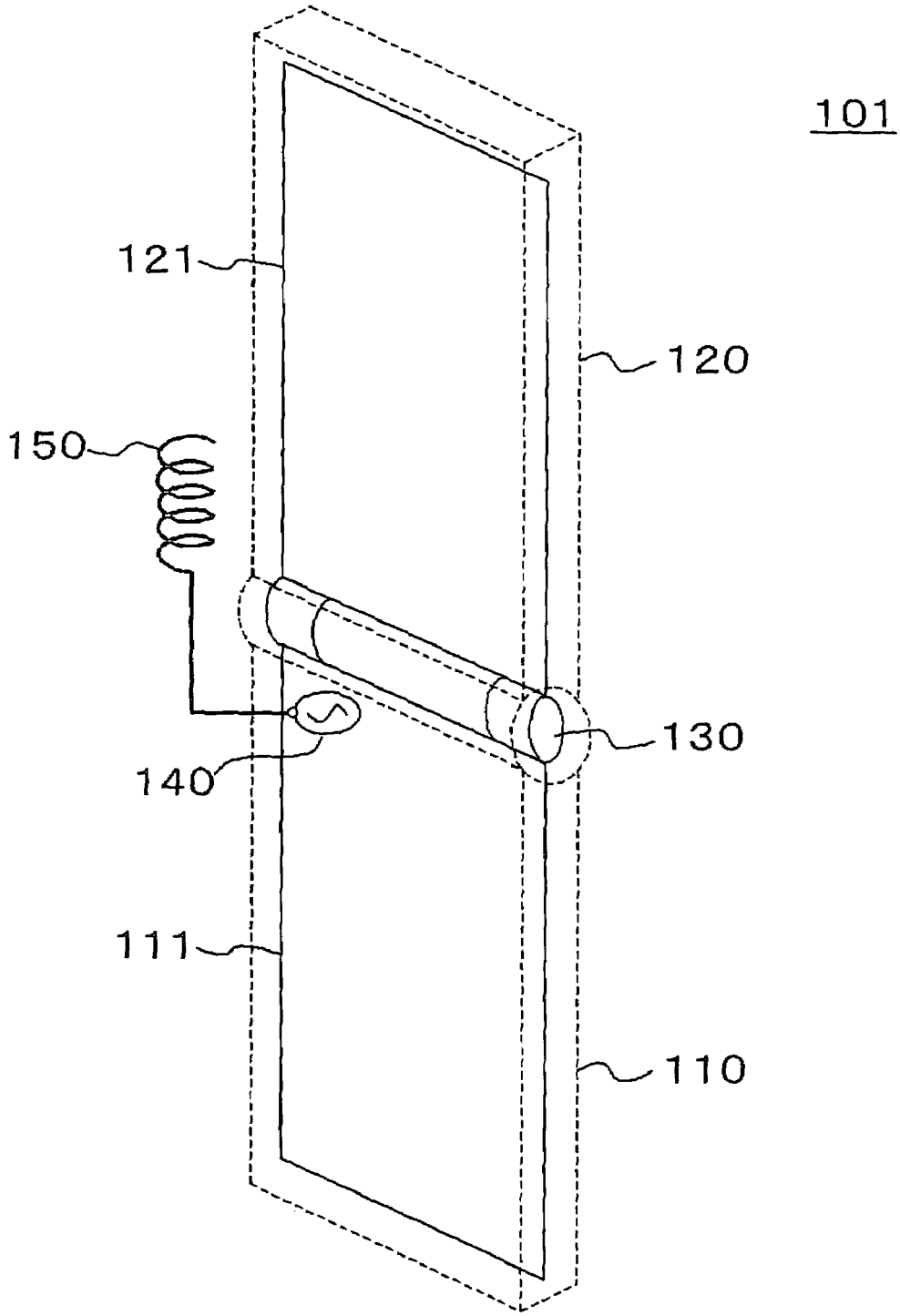
FIG . 11 PRIOR ART

FIG. 11 is a perspective view schematically showing the structure of a mobile telephone relating to a conventional example.

Figure 12:
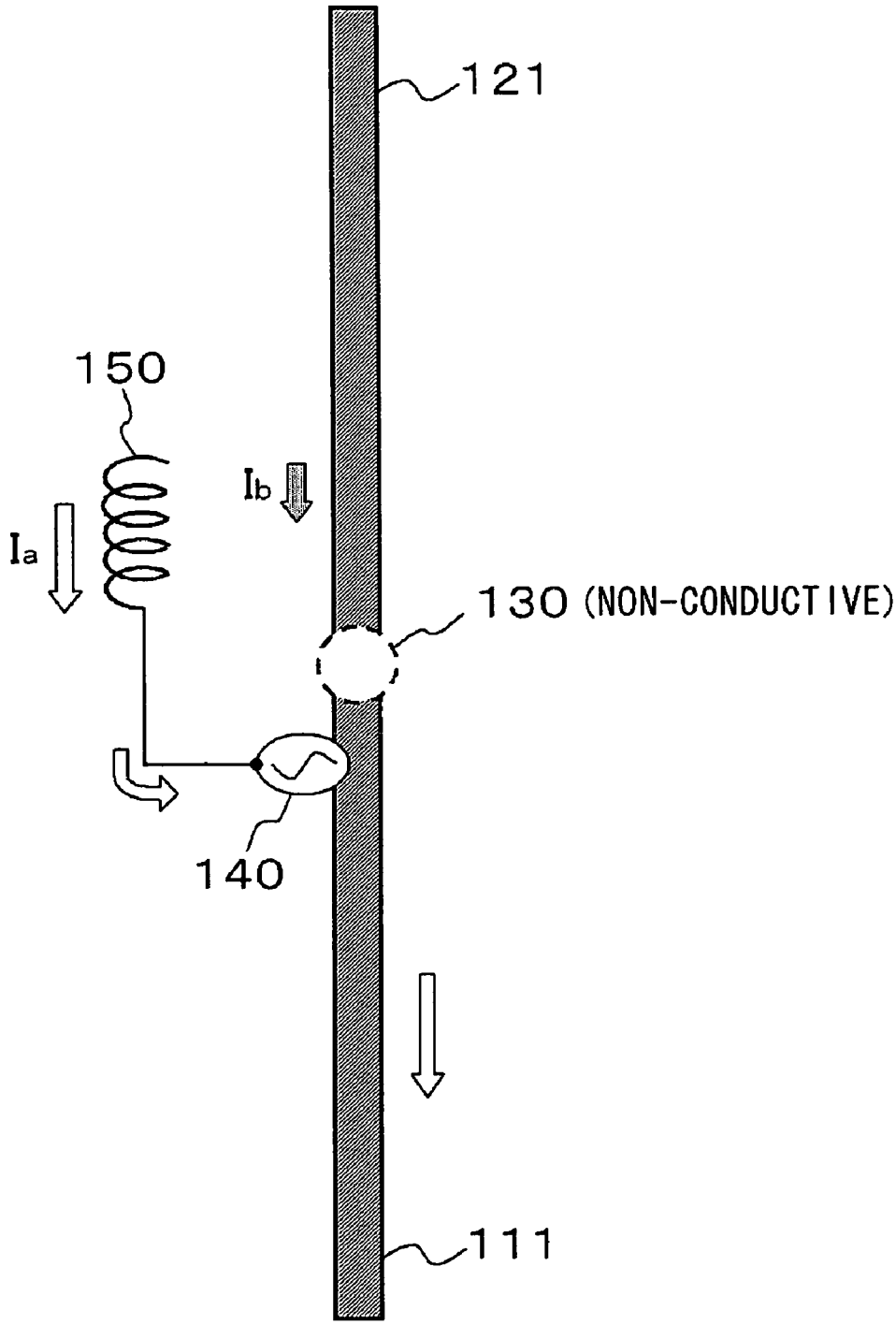

FIG. 12 is a schematic diagram for analyzing how a current flows when the casings are opened and the joint part of the mobile telephone relating to the conventional example is not conductive.

Figure 13:
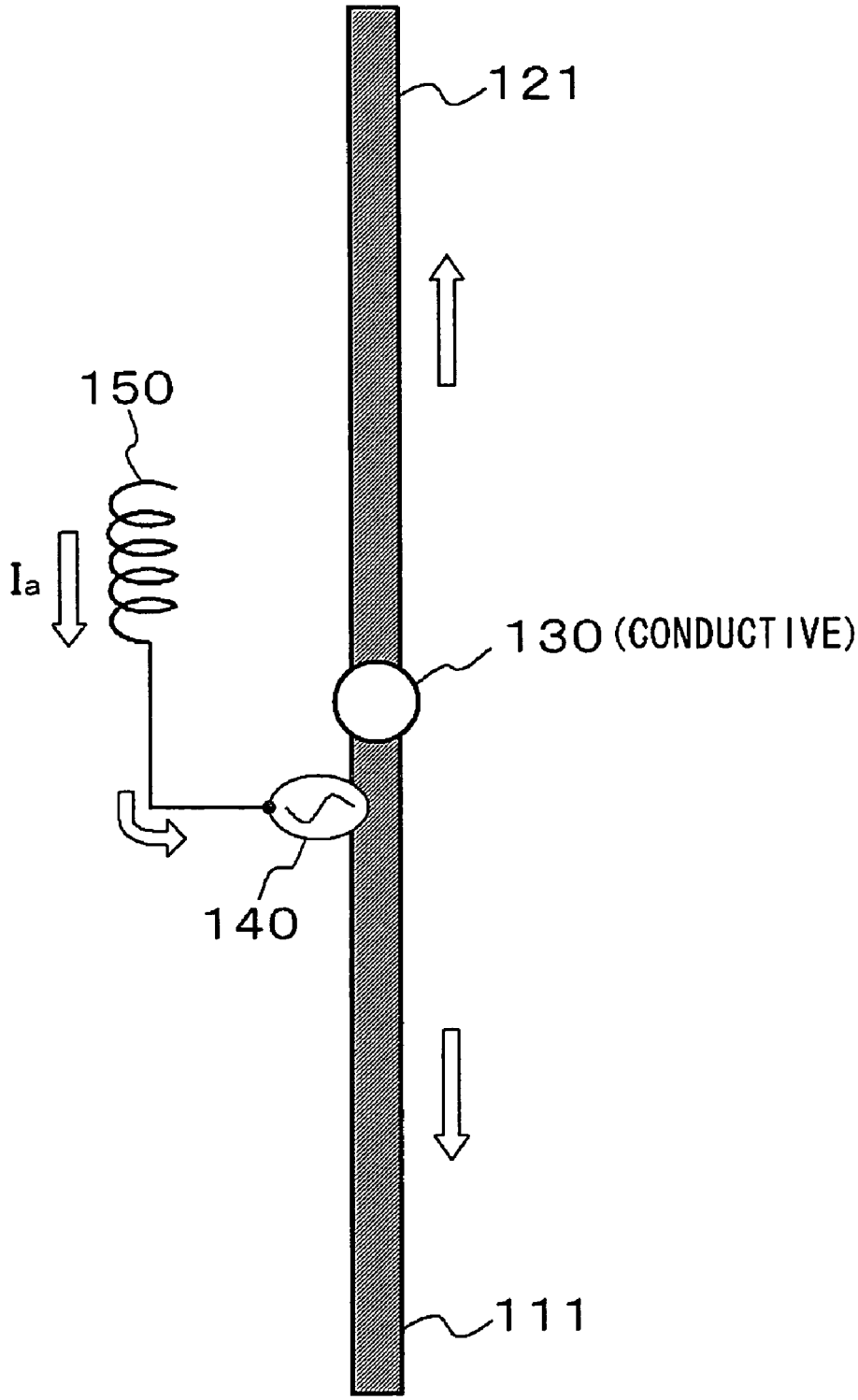
FIG . 13 PRIOR ART

FIG. 13 is a schematic diagram for analyzing how a current flows when the casings are opened and the joint part of the mobile telephone relating to the conventional example is conductive.

PREFERRED EMBODIMENTS OF THE INVENTION

Figure 1:
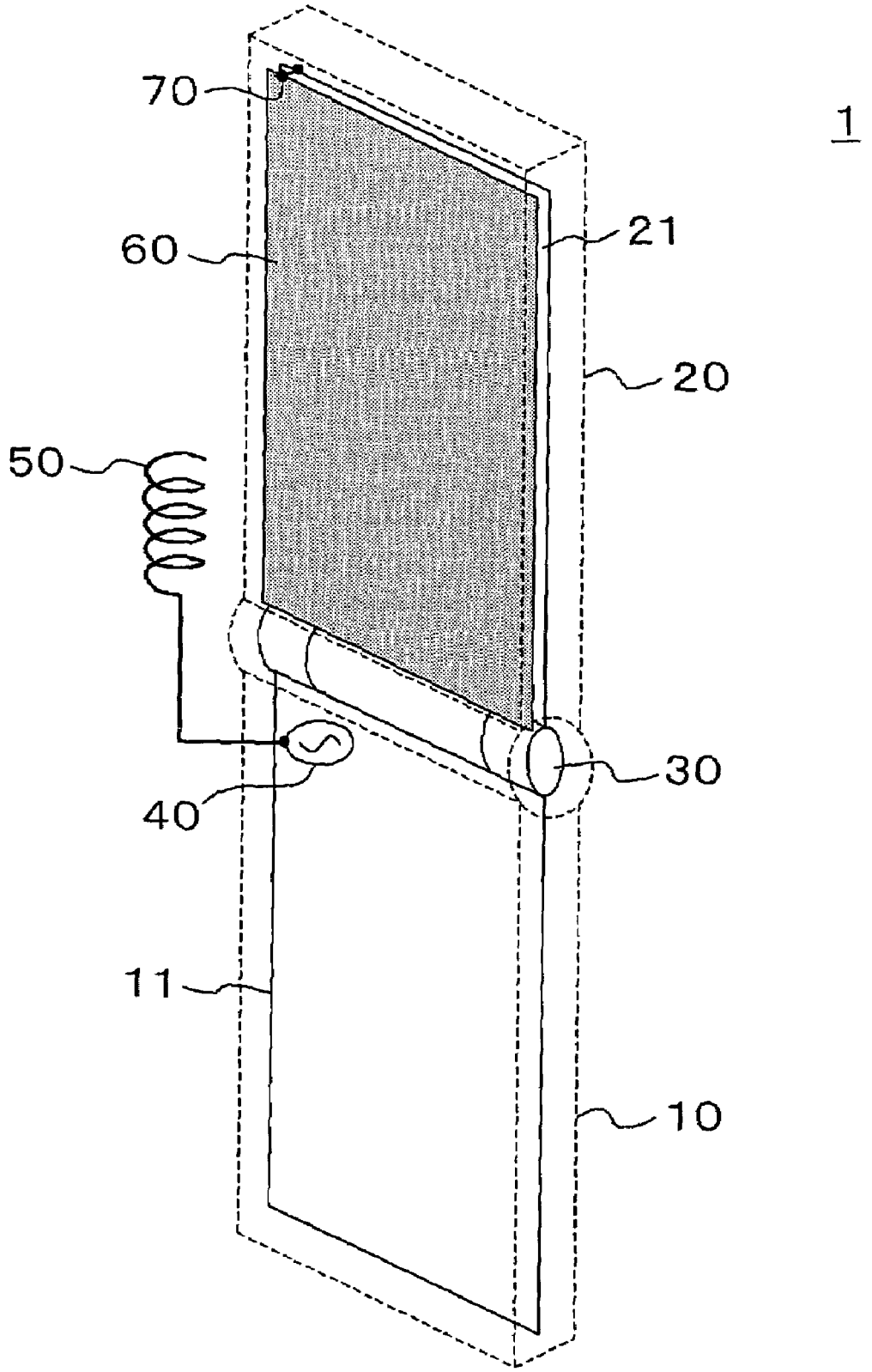
FIG. 1 is a perspective view schematically showing the structure of a mobile telephone relating to Embodiment 1 of the present invention.

Embodiment 1 of the present invention will be described with reference to the drawings. FIG. 1 is a perspective view schematically showing the structure of a mobile telephone relating to Embodiment 1 of the present invention.

The mobile telephone 1 is a foldable mobile telephone made up by foldably jointing a first casing (refer to a first casing external surface 10) and a second casing (refer to a second casing external surface 20), and it comprises a first conductive part 11, a second conductive part 21, a joint part 30, a power supply (feeder) part 40, an antenna 50, an inverse element 60, and a (electrically) connecting part 70.

The first conductive part 11 includes a conductive part for components (circuit substrates, electronic parts, frames, etc.) housed in the first casing and a conductive part of the first casing in applicable cases, and as a whole, it can be considered to be a plate-shaped part disposed inside the first casing in terms of antenna characteristics. The first conductive part 11 is electrically connected to the power supply part 40. When a whole or part of the first casing is made up of a conductor such as magnesium alloy, the first conductive part 11 includes a part relating to this conductor. When the first casing is wholly made up of an insulator, the first casing does not belong to the first conductive part 11.

The second conductive part includes a conductive part for components (circuit substrates, electronic parts, frames, etc.) housed in the second casing and a conductive part of the second casing in applicable cases, and as a whole, it can be considered to be a plate-shaped part disposed inside the second casing in terms of antenna characteristics. Further, when a part of the second casing is made up of a conductor such as magnesium alloy, the second conductive part 21 includes a part relating to this conductor. However, among the second casing and the components housed therein, the second conductive part 21 does not include parts functioning as the inverse element 60 and connecting part 70. For instance, if the second casing can be divided into an operation side casing, where operation buttons are provided, and an antenna side casing on the other side (the side of the antenna), the antenna side casing will not be included in the second conductive part 21 because of the positional relationship between the antenna 50 and the antenna side casing. However, if a conductor such as magnesium alloy is used for the operation side casing, the part relating to this conductor is included.

The joint part 30 mechanically (pivotably) joints the first conductor part 11 and the second conductor part 21, thus making the mobile telephone foldable, and it may be of a hinged or revolving fashion. The joint part 30 is conductive and it electrically connects the first conductor part 11 and the second conductor part 21 (including capacitive coupling for high-frequency current).

The power supply part 40 supplies power to the antenna 50, and is disposed near the joint part 30 of the first conductive part 11 inside of the fist casing.

Figure 2A:
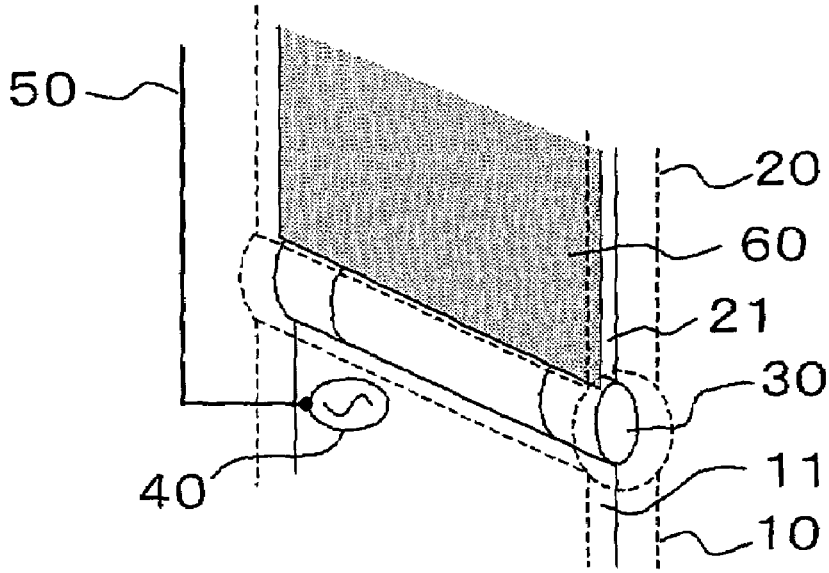
FIGS. 2A and 2B are partial perspective views schematically showing variations of the antenna in the structure of the mobile telephone relating to Embodiment 1 of the present invention.
Figure 2B:
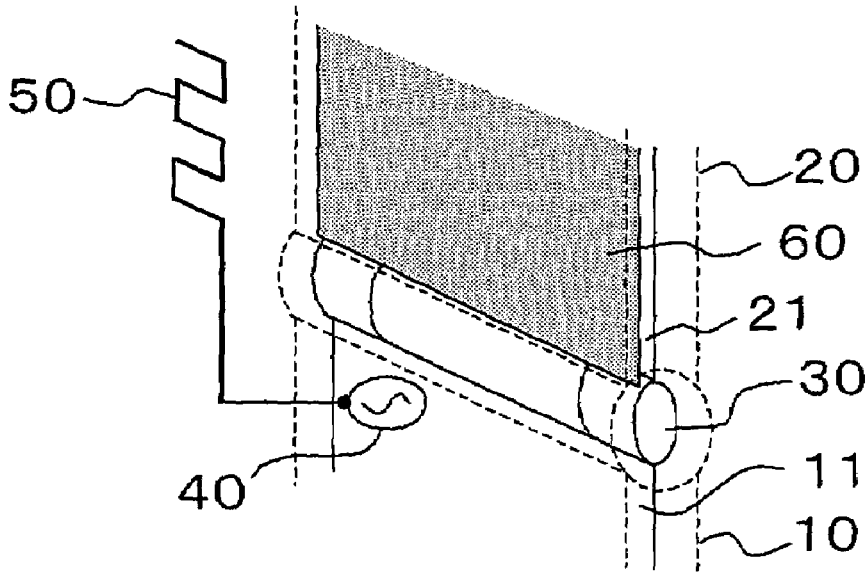

The antenna 50 is taken out from the area near the joint part 30 of the first conductive part 11 to the outside of the first casing (refer to the first casing external surface 10), and becomes an external antenna extended towards the second casing (refer to the second casing external surface 20) when the mobile telephone is opened. The antenna 50 is electrically connected to the power supply part 40, and operates as an antenna by being excited for oscillation between itself and the first conductive part 11. When the mobile telephone 1 is opened, the extended part near the tip of the antenna 50 is at a position close to the second conductive part 21 and at a prescribed distance from the second casing external surface 20. The tip portion of the antenna 50 is spiral-shaped (coil-shaped, helical-shaped). Other than spiral, the tip portion of the antenna 50 may also be straight (refer to FIG. 2A) or meander-shaped (refer to FIG. 2B). The antenna may be made thinner by making it straight or meander-shaped.

The inverse element 60 guides a conduction current flowing through the second conductive part 21 to flow in the inverse direction. Here, the inverse direction means the opposite (vector component) of the direction of the conduction current flowing from the joint part 30 side of the second conductive part 21 (the end side) to the top side, and corresponds to the direction from the tip side of the antenna 50 to its base end side. The inverse element 60 is a plate-shaped conductor and is provided in the region that overlaps with the whole surface of the antenna side, looking from the direction normal of the second conductive part 21 in FIG. 1. The plate of the inverse element 60 may have either a plane or curved surface. The inverse element 60 is disposed at a prescribed distance from the second conductive part 21, it does not have any part in contact with the first conductive part 11, the second conductive part 21, the joint part 30, the power supply part 40, and the antenna 50, and it is electrically connected to the second conductive part 21 via the connecting part 70. The longer the distance between the inverse element 60 and the second conductive part 21 is, the more effectively antenna characteristics improve, however, it is also possible to make the distance shorter by adjusting the size (length and width) of the inverse element 60. The inverse element 60 is disposed between the second conductive part 21 and the antenna 50, and approximately parallel to the second conductive part 21. Further, the inverse element 60 may also be disposed so that it is approximately parallel to the extending direction of the antenna 50, and forms an acute angle (if any) with the second conductive part 21. A plate-shaped conductor such as a metal plate, sheet metal, and metal foil is used for the inverse element 60. A metallic plating layer may be applied on the surface of the plate-shaped conductor in order to improve conductivity or prevent oxidation. Further, a mould (for instance the inner surface of the second casing made up of a mould) whose surface is coated with a conductive material by plating or vapor-deposition may be used for the inverse element 60. When a part of the second casing is made up of a conductor such as magnesium alloy, this part relating to the conductor may be used as the inverse element 60. For instance, if the second casing can be divided into an operation side casing, where operation buttons are provided, and a antenna side casing on the other side (the side of the antenna), the antenna side casing can be used as the inverse element 60.

The connecting part 70 electrically connects the inverse element 60 and the second conductive part 21. The connecting part 70 is provided at a prescribed distance from the joint part 30 and closer to the top of the second conductive part 21 (the opposite side of the joint part 30) than the tip of the antenna 50. In FIG. 1, the connecting part 70 is jointed to the top end of the second conductive part 21 and the end of the inverse element 60 near it. In order to match impedances, the connecting part 70 may electrically connect the inverse element 60 and the second conductive part 21 not only with one wiring as shown in FIG. 1, but also with two or more wirings (refer to 70*a* and 70*b* in FIG. 3A), and it may also electrically connect the wire end (or end face) of the second conductive part 21 towards the top end thereof and the wire end (or end face) of the inverse element 60 near it. Further, a connector may be used for the connecting part 70 in order to improve the connection reliability between the inverse element 60 and the second conductive part 21 (refer to 70*c* in FIG. 3B). In order to match impedances, the connecting part 70 may electrically connect the surface of the second conductive part 21 at or towards the top end and the surface of the inverse element 60 opposite thereto (refer to 70*d* in FIG. 3C). A conductive cushioning (or resilient) member may be used for the connecting part 70 in order to absorb shock when dropped and prevent damage (refer to 70*d* in FIG. 3C). Further, the connecting part 70 may provide a capacitive coupling (coupling via capacitor) between the inverse element 60 and the second conductive part 21 for a high-frequency current in terms of antenna characteristics.

Next, the operation of the mobile telephone relating to Embodiment 1 will be described with reference to the drawings. FIG. 4 is a schematic cross-section for explaining the current flow in the mobile telephone relating to Embodiment 1 of the present invention.

A current (image current) flows from the tip of the antenna 50 to the power supply part 40 when the antenna 50 is excited by the power supply part 40. The current $I_a$ flowing in the antenna 50 also flows in the first conductive part 11 via the power supply part 40. The current flowing in the first conductive part 11 flows away from the power supply part 40. Therefore, the current flowing in the antenna 50 and the current flowing in the first conductive part 11 essentially flow in the same direction (having the vector components in the same direction) except in a narrow region between the power supply part 40 and the joint part 30.

The current flowing in the first conductive part 11 flows to the second conductive part 21 as a conduction current via the conductive joint part 30. The conduction current flowing in the second conductive part 21 flows away from the joint part 30. Therefore, the current flowing in the antenna 50 and the current flowing in the second conductive part 21 essentially flow in the opposite direction (having the vector components in the opposite direction to each other).

The conduction current flowing in the second conductive part 21 further flows in the inverse element 60 via the connecting part 70 provided at the top (the opposite side of the joint part 30) of the second conductive part 21. The conduction current flowing in the second conductive part 21 and the current flowing in the inverse element 60 have the same phase, however, the connecting part 70 make the current flowing in the inverse element 60 and the conduction current flowing in the second conductive part 21 flow in the opposite direction. Therefore, the direction of the current in the inverse element 60 that flows near the antenna 50 is the same as that of the current flowing in the antenna 50 (having vector components in the same direction).

According to Embodiment 1, the influence of the current (the conduction current flowing in the second conductive part 21; the current that essentially flows in the opposite direction to the current flowing in the antenna 50) that causes antenna characteristics to deteriorate can be reduced by providing the inverse element 60 between the antenna 50 and the second conductive part 21, thereby reducing the deterioration of antenna characteristics.

Embodiment 2 of the present invention will be described with reference to the drawings. FIG. 5 is a perspective view schematically showing the structure of a mobile telephone relating to Embodiment 2 of the present invention.

In Embodiment 2, the inverse element 60 is provided in a region that, looking from the side of the antenna 50, overlaps with a part of the surface of the second conductive part 21 on the antenna side and that includes a region where at least the antenna 50 and the second conductive part 21 overlap. The inverse element 60 is disposed at prescribed distances from the antenna 50 and the second conductive part 21. Except for this, Embodiment 2 is structured identically to Embodiment 1.

Figure 6B:
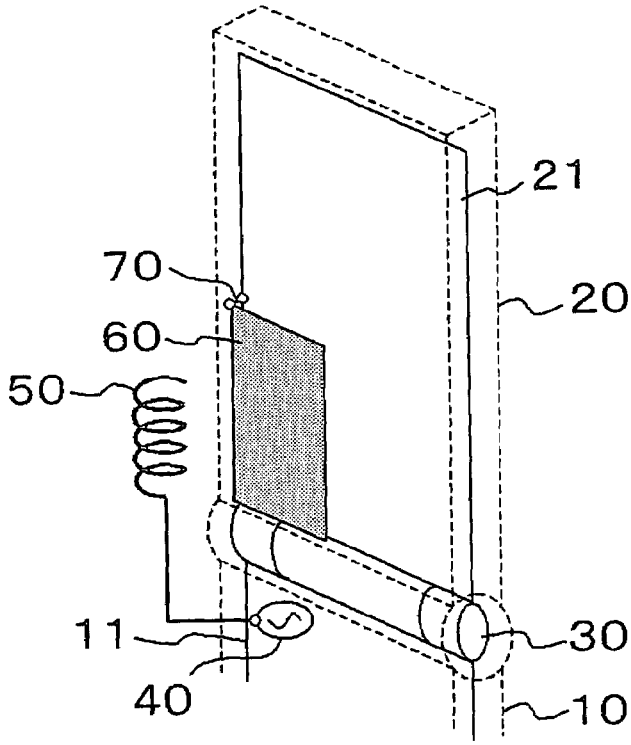

As a variation of Embodiment 2, the length of the inverse element 60 may be shortened as shown in FIG. 6A rather than (or not only with) narrowing in the width thereof as shown in FIG. 5. Further, the connection between the connecting part 70 and the second conductive part 21 may be made at a midpoint of the second conductive part 21 as shown in FIG. 6B rather than at the top of it as shown in FIG. 5. In order to match impedances, it is preferable that: (1) the inverse element 60 be small in the long direction when the communication wavelength is short for (relative to) the length of the casing, and big in the long direction when the communication wavelength is long for the length of the casing, (2) the inverse element 60 be small in the short direction when the communication wavelength is long for the length of the casing, and big in the short direction when the communication wavelength is short for the length of the casing, (3) the connecting part 70 be disposed near the joint part 30 when the communication wavelength is short for the length of the casing, and away from the joint part 30 when the communication wavelength is long for the length of the casing.

Further, as shown in FIGS. 7A and 7B, the width of the inverse element 60 on the joint part 30 side (the width in the short direction) may be narrower than the width on the connecting part 70 side (the width in the short direction) not only making the inverse element 60 rectangular as shown in FIG. 5.

According to Embodiment 2, the current flowing in the inverse element 60 can be converged at the region closer to the antenna 50 than the current flowing in the inverse element in Embodiment 1 (60 in FIG. 1). And by the dielectric action of the converged current flowing in the inverse element 60, the current flowing in the antenna 50 increases, improving antenna characteristics as a result.

Embodiment 3 of the present invention will be described with reference to the drawings. FIG. 8 is a perspective view schematically showing the structure of a mobile telephone relating to Embodiment 3 of the present invention. In Embodiment 3, openings 60*a* and 60*b* such as a hole and notch are added to the inverse element 60. It is preferable that the openings 60*a* and 60*b* should not be provided in the region near the antenna 50 from the standpoint of antenna characteristics, however, even if the openings 60*a* and 60*b* are provided in the region near the antenna 50, antenna characteristics of a mobile telephone with the inverse element 60 will be better than the one without it. In this case, the inverse element 60 should occupy the area not smaller than 10% and not bigger than 100% of the region where the antenna 50 and the second conductive part 21 overlap, looking from the side of the antenna 50, preferably it should occupy the area not smaller than 80% and not bigger than 100% or even more preferably the area not smaller than 90% and not bigger than 100%. Except for this, Embodiment 3 is structured identically to Embodiments 1 and 2. According to the present embodiment, the inverse element 60 can be provided even when it conflicts with other components considering the structure of the casings and internal mounting. For instance, even when a liquid crystal screen, camera, light, and LED are in an area where the inverse element 60 needs to be disposed, the inverse element 60 can be applied.

Next, Embodiment 4 of the present invention will be described with reference to the drawings. FIG. 9 is a perspective view schematically showing the structure of a mobile telephone relating to Embodiment 4 of the present invention. In Embodiment 4, as means for electrically connecting the inverse element 60 and the second conductive part 21, a part of the inverse element 60 is made into a connecting part 60*c*, and the connecting part 60*c* and the second conductive part 21 are conducted by pushing the connecting part 60*c* against the second conductive part 21 or conductive bonding. Except for this, Embodiment 4 is structured identically to Embodiments 1 through 3. According to Embodiment 4, the necessity for connector or the like is eliminated, reducing the cost.

Embodiment 5 of the present invention will be described with reference to the drawings. FIG. 10 is a cross-section schematically showing the structure of a mobile telephone relating to Embodiment 5 of the present invention. In Embodiment 5, a spacer 80 is interposed between the inverse element 60 and the second conductive part 21. The spacer 80 is made up of a insulating material and/or film, and it is preferable that a low-k dielectric be used since the space between the inverse element 60 and the second conductive part 21 can be made small. Further, in order to absorb shock when dropped and prevent damage, an insulating cushioning material may be used for the spacer 80. The spacer 80 can be stuck on the surface of either the inverse element 60 or the second conductive part 21, or both the surfaces. Except for this, Embodiment 5 is structured identically to Embodiments 1 through 4. According to Embodiment 5, it is possible to avoid the inverse element 60 from contacting the second conductive part 21 through a part other than the connecting part 70.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

EXPLANATIONS OF SYMBOLS

1, 101: mobile telephone
10, 110: first casting external surface
11, 111: first conductive part
20, 120: second casting external surface
21, 121: second conductive part
30, 130: joint part
40, 140: power supply (feeder) part
50, 150: external antenna
60: inverse element
60*a,* 60*b:* opening
60*c:* connecting part
70: connecting part
70*a,* 70*b:* wiring
70*c:* connector
70*d:* conductive cushion
80: spacer

What is claimed is:

1. A mobile telephone comprising:

an inverse element provided in a whole or part of a region where at least said antenna and a conductive part overlap, said inverse element being disposed between said antenna and said conductive part at prescribed, respective distances from said antenna and said conductive part, causing a current flowing from said conductive part to flow in an inverse direction to that in which a current flows in said conductive part.

2. The mobile telephone as defined in claim 1 wherein said inverse element is a plate-shaped conductor and disposed approximately parallel to one or both of said second conductive part and said antenna.

3. The mobile telephone as defined in claim 1 wherein said inverse element has either a hole or notch or both at prescribed position.

4. The mobile telephone as defined in claim 1 wherein said inverse element is small in the long direction when the communication wavelength is short for the length of the casing, and big in the long direction when the communication wavelength is long for the length of the casing.

5. The mobile telephone as defined in claim 1 wherein said inverse element is small in the short direction when the communication wavelength is long for the length of the casing, and big in the short direction when the communication wavelength is short for the length of the casing.

6. The mobile telephone as defined in claim 1 wherein the width of said inverse element in the short direction at a position of said joint part is narrower than the width in the short direction at a position of said connecting part.

7. The mobile telephone as defined in claim 1 wherein said antenna has a coil-shaped tip.

8. A mobile telephone comprising:

an inverse element provided in a whole or part of a region where at least said antenna and a conductive part overlap, said inverse element being disposed between said antenna and said conductive part at prescribed, respective distances from said antenna and said conductive part, and electrically connected to said conductive part via at least one connecting part at a position away from a part of said conductive part that supplies power to said antenna and further away from a tip of said antenna.

9. A mobile telephone comprising:

a conductive part disposed at a prescribed position or positions of one or both of a casing and a member mounted inside said casing;

an antenna led out outside said casing and extended towards a prescribed direction near said conductive part;

a power supply part provided at a prescribed position of said conductive part and supplying power to said antenna; and an inverse element provide in a whole or part of a region where at least said antenna and said conductive part overlap, said inverse element being disposed between said antenna and said conductive part at prescribed, respective distances from said antenna and said conductive part, causing a current flowing from said conductive part to flow in an inverse direction to that in which a current flows in said conductive part.

10. A mobile telephone comprising:

a conductive part disposed at a prescribed position or positions of one or both of a casing and a member mounted inside said casing;

an antenna led out outside said casing and extended towards a prescribed direction near said conductive part;

a power supply part provided at a prescribed position of said conductive part and supplying power to said antenna; and an inverse element provided in a whole or part of a region where at least said antenna and said conductive part overlap, said inverse element being disposed between said antenna and said conductive part at prescribed, respective distances from said antenna and said conductive part, and electrically connected to said conductive part via at least one connecting part at a position away from said power supply part and further away from a tip of said antenna.

11. A mobile telephone comprising:

a first conductive part disposed at a prescribed position of one or both of a first casing and a member mounted inside said first casing;

a second conductive part disposed at a prescribed position of one or both of a second casing and a member mounted inside said second casing, foldably jointed to said first conductive part by a point part, and electrically connected to said first conductive part;

an antenna led out outside said first casing from an area near said joint part of said first casing and extended towards a prescribed direction near said second conductive part when said first and second casings are opened;

a power supply part provided near said joint part of said first conductive part and supplying power to said antenna; and an inverse element disposed in a whole or part of a region where at least said antenna and said second conductive part overlap when said first and second casings are opened, said inverse element being provided between said antenna and said second conductive part at prescribed, respective distances from said antenna and said second conductive part, causing a current flowing from said second conductive part to flow in an inverse direction to that which a current flows in said second conductive part.

12. The mobile telephone as defined in claim 11 wherein said inverse element is a plate-shaped conductor and disposed approximately parallel to one or both of said second conductive part and said antenna.

13. The mobile telephone as defined in claim 11 comprising a spacer made up of an insulating material and interposed between said inverse element and said second conductive part.

14. The mobile telephone as defined in claim 13 wherein said spacer is made up of an insulating cushioning material.

15. A mobile telephone comprising:

a first conductive part disposed at a prescribed position of one or both of a first casing and a member mounted inside said first casing;

a second conductive part disposed at a prescribed position of one or both of a second casing and a member mounted inside said second casing, foldably jointed to said first conductive part by a joint part, and electrically connected to said first conductive part;

an antenna led out outside said first casing from an area near said joint part of said first casing and extended towards a prescribed direction near said second conductive part when said first and second casings are opened;

a power supply part provided near said joint part of said first conductive part and supplying power to said antenna; and an inverse element disposed in a whole or part of a region where at least said antenna and said second conductive part overlap when said first and second casings are opened; said inverse element being provided between said antenna and said second conductive part at prescribed, respective distances from said antenna and said second conductive part, and electrically connected to said second conductive part via at least one connecting part at a position away from said joint part and further away from a tip of said antenna.

16. The mobile telephone as defined in claim 15 wherein said inverse element is a plate-shaped conductor and disposed approximately parallel to one or both of said second conductive part and said antenna.

17. The mobile telephone as defined in claim 15 wherein said connecting part is disposed near said joint part when the communication wavelength is short for the length of the casing, and away from said joint part when the communication wavelength is long for the length of the casing.

18. The mobile telephone as defined in claim 15 wherein said connecting part comprises a connector.

19. The mobile telephone as defined in claim 15 wherein said connecting part is made up of a cushioning conductive material and interposed between said inverse element and said second conductive part.

20. The mobile telephone as defined in claim 15 wherein said connecting part has a capacitive coupling portion for a high-frequency current.

* * * * *